US010534292B2

(12) United States Patent
Borenstain et al.

(10) Patent No.: US 10,534,292 B2
(45) Date of Patent: Jan. 14, 2020

(54) OPERATING A LIQUID ELECTROPHOTOGRAPHIC PRINTER

(71) Applicant: HP INDIGO B.V., Amstelveen (NL)

(72) Inventors: Shmuel Borenstain, Ness Ziona (IL); Shahar Stein, Ness Ziona (IL); Asaf Anufa, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/098,185

(22) PCT Filed: Jul. 20, 2016

(86) PCT No.: PCT/EP2016/067346
§ 371 (c)(1),
(2) Date: Nov. 1, 2018

(87) PCT Pub. No.: WO2018/014958
PCT Pub. Date: Jan. 25, 2018

(65) Prior Publication Data

US 2019/0146378 A1 May 16, 2019

(51) Int. Cl.

| | |
|---|---|
| ***G03G 15/10*** | (2006.01) |
| ***G03G 21/00*** | (2006.01) |
| ***G03G 21/10*** | (2006.01) |

(52) U.S. Cl.
CPC ..... *G03G 15/104* (2013.01); *G03G 15/10* (2013.01); *G03G 15/101* (2013.01); *G03G 21/0094* (2013.01); *G03G 21/10* (2013.01); *G03G 21/105* (2013.01); *G03G 2215/0658* (2013.01)

(58) Field of Classification Search
CPC ..... G03G 15/10; G03G 15/11; G03G 15/104; G03G 21/10; G03G 21/0088; G03G 21/0094; G03G 2215/0658; G03G 2221/0026; G03G 2221/0036; G03G 2221/1621
See application file for complete search history.

(56) References Cited

U.S. PATENT DOCUMENTS

| | | | |
|---|---|---|---|
| 7,496,324 | B2 | 2/2009 | Sugiura et al. |
| 7,938,528 | B2 | 5/2011 | Thayer et al. |
| 8,313,190 | B2 | 11/2012 | Castillo et al. |
| 8,485,621 | B2 | 7/2013 | Fiorvanti et al. |
| 2007/0019996 | A1 | 1/2007 | Romem |
| 2008/0310897 | A1 | 12/2008 | Naruse et al. |

(Continued)

FOREIGN PATENT DOCUMENTS

| | | | |
|---|---|---|---|
| EP | 1473602 | A1 | 11/2004 |
| WO | WO-2012097877 | A1 | 7/2012 |
| WO | WO-2016020015 | A1 | 2/2016 |

OTHER PUBLICATIONS

Harpavat, Ganesh L. "A theoretical study of the mechanics of a xerographic cleaning blade." IEEE Transactions on Industry Applications 6 (1979): 681-687.

*Primary Examiner* — Thomas S Giampaolo, II
(74) *Attorney, Agent, or Firm* — Michael A Dryja

(57) ABSTRACT

An example method of performing a null cycle in a liquid electrographic printer is described. The method involves collecting, at a photo imaging plate cleaning station, imaging oil deposited on a photo imaging plate during a print cycle. During a null cycle, the photo imaging plate cleaning station is controlled to apply the collected imaging oil to the photo imaging plate.

18 Claims, 8 Drawing Sheets

(56) References Cited

U.S. PATENT DOCUMENTS

| | | | | |
|---|---|---|---|---|
| 2009/0190975 | A1 | 7/2009 | Thayer | |
| 2009/0304407 | A1 | 12/2009 | Thayer et al. | |
| 2010/0251916 | A1 | 10/2010 | Peles et al. | |
| 2013/0064591 | A1* | 3/2013 | Salalha | G03G 15/104 399/357 |

* cited by examiner

OPERATING A LIQUID ELECTROPHOTOGRAPHIC PRINTER

BACKGROUND

Liquid Electro-Photography (LEP) printing devices form images on print media by placing a uniform electrostatic charge on a photoreceptor and then selectively discharging the photoreceptor in correspondence with the images. The selective discharging forms a latent electrostatic image on the photoreceptor. Ink comprising charged colorant particles suspended in imaging oil is then developed from a binary ink development unit on to the latent image formed on the photoreceptor. The image developed on the photoreceptor is offset to an image transfer element, where it is heated until the solvent evaporates and the resinous colorants melt. This image layer is then transferred to the surface of the print media being supported on a rotating impression drum.

Non-productive print cycles, referred to herein as null cycles, may be scheduled to occur before, during or after normal printing sessions. Such null cycles may be included, for example, to maintain synchronization between different subsystems of the printing device. For example, a null cycle may be included between print jobs, during a substrate change, while waiting for another subsystem to finish an operation, or while waiting for a temperature of a component of the printing device to stabilize.

During null cycles, latent images are not formed on the photoreceptor or transferred to the photoreceptor or image transfer element. The lack of ink transfer during null cycles can damage the photoreceptor and the image transfer element and reduce print quality. Therefore, in order to protect the photoreceptor and the image transfer element, some LEP systems perform so-called wet null cycles, in which a binary ink development unit transfers imaging oil, but not charged ink particles, to the photoreceptor. The transferred imaging oil helps to lubricate and protect the photoreceptor and the image transfer element.

BRIEF DESCRIPTION OF THE DRAWINGS

Various features and advantages of the present disclosure will be apparent from the detailed description which follows, taken in conjunction with the accompanying drawings, which together illustrate, by way of example only, features of the present disclosure, and wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1:
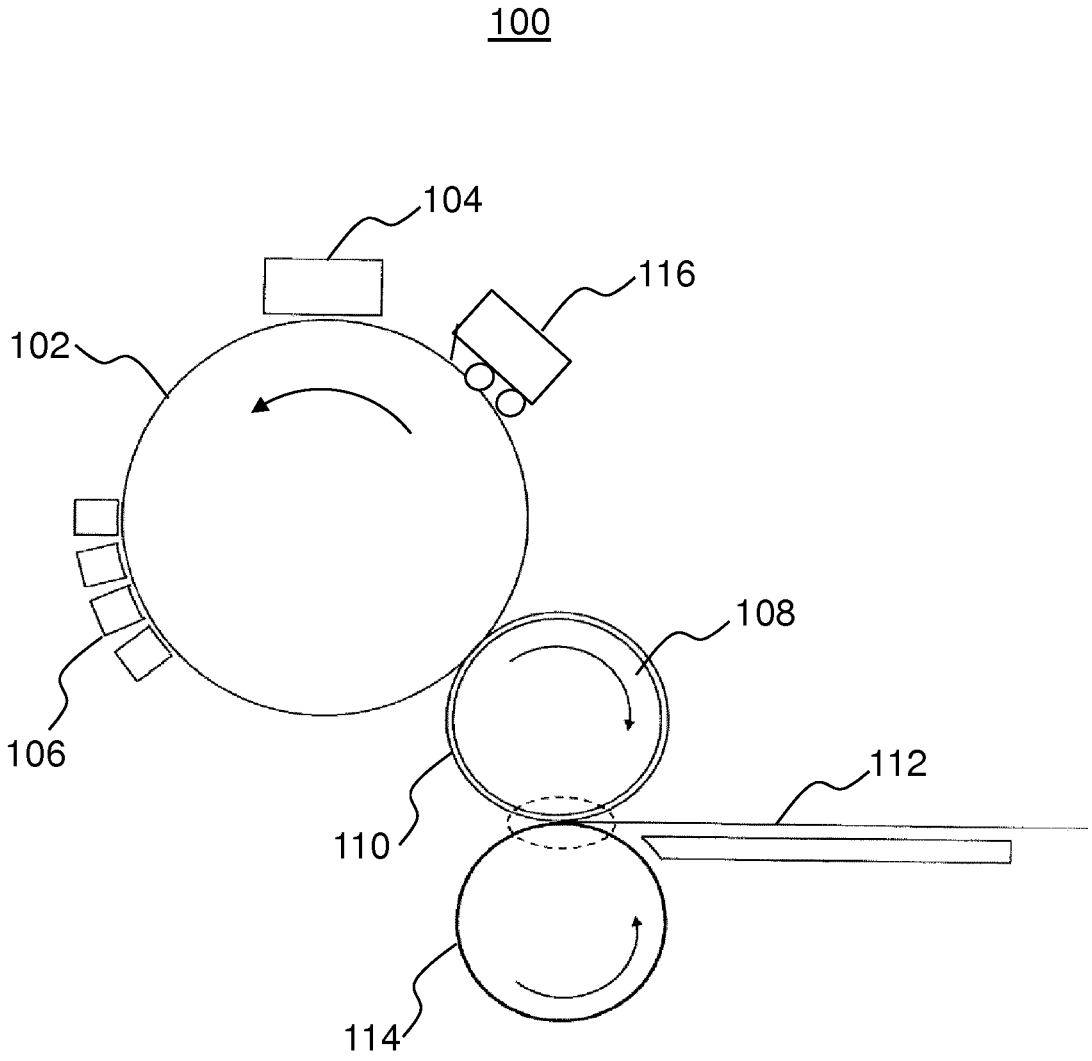
FIG. 1 is a schematic diagram showing a cross section of a print engine in a liquid electrographic printer according to an example.

FIG. 1 illustrates the components of a print engine 100 in a liquid electrophotographic printer (LEP). The print engine 100 includes a photo imaging plate 102 (referred to hereinafter as a PIP), a latent image forming unit 104, and one or more binary ink development units 106 (referred to hereinafter as a BID unit) to develop an ink image on the PIP 102.

In the example print engine 100 of FIG. 1, a desired image is initially formed as a latent electrostatic image on the PIP 102. For example, an image is formed on the PIP 102 by rotating a clean, bare segment of the PIP 102 under the latent image forming unit 104. The latent image forming unit 104 may include a charging device, such as corona wire, charge roller, or other charging device, and a laser imaging portion. A uniform static charge may be deposited on the PIP 102 by the latent image forming unit 104. As the PIP 102 continues to rotate, a charged portion of the PIP 102 passes the laser imaging portion of the latent image forming unit 104. The laser imaging unit may dissipate localized charge in selected portions of the PIP 102 to leave a latent electrostatic charge pattern corresponding to an image to be printed. In some examples, the latent image forming unit 104 applies a negative charge to the surface of the PIP 102. In other examples, the charge may be a positive charge. The laser imaging portion of the latent image forming unit 104 may then locally discharge portions of the PIP 102, resulting in local neutralized regions on the PIP 102.

During a print cycle, at least one of the BID units 106 is engaged with the PIP 102. The engaged BID is to apply liquid ink to the PIP 102. The liquid ink comprises electrically charged ink particles that are attracted to the oppositely charged portions of the PIP 102. The ink particles may be repelled from other areas of the PIP 102. The result is that an image is developed onto the latent electrostatic image provided on the PIP 102.

The print engine 100 also includes an image transfer member 108 comprising a drum around which is wrapped a blanket 110. Following development of an image on the PIP 102, the PIP 102 continues to rotate and transfers the printing substance, in the form of the image, to the blanket layer 110. In some examples, the image transfer member 108 is electrically charged to facilitate transfer of the image to the blanket 110.

The image transfer member 108 transfers the image from the blanket 110 to a substrate 112 located between the image transfer member 108 and an impression cylinder 114. This process may be repeated, if more than one layer is to be included in a final image to be provided on the substrate 112.

Following transfer of ink from the PIP 102 to the image transfer member 108, the PIP 102 passes a photo imaging plate cleaning station 116 (referred to hereinafter as a cleaning station) to prepare the surface of the PIP 102 for recharging and for a new latent image to be formed. The cleaning station comprises one or more cleaning sponges, to clean residual ink from the surface of the PIP 102, and one or more wiper blades to remove imaging oil from the surface of the PIP 102 cleaned by the sponge(s).

Throughout the printing process, the PIP 102 and the blanket 110 encounter a number of wear mechanisms that may cause them damage. Damage to the PIP 102 and the blanket 110 may eventually have a negative impact on the quality of the printed output. Therefore, such wear mechanisms shorten the useful lifespan of the PIP 102 and the blanket 110. Replacing the PIP 102 and the blanket 110 is expensive and reduces printer throughput because of the time involved in the replacement process.

A common blanket wear mechanism is referred to as blanket memory. Blanket memory can cause damage to a blanket through the continual placement of the same or similar images in the same position on the blanket. If an image is printed many times (i.e. the same or a similar image), so that ink is repeatedly applied to the same areas of the blanket while being repeatedly omitted from other areas of the blanket, there is differential damage over time between the areas in which ink is applied and areas in which ink is not applied. Subsequently, when a different image is printed that calls for the application of ink onto the blanket in areas where ink has or has not been previously applied, the appearance of the printed image may vary between those areas.

Another blanket wear mechanism is the repeated pressing of the substrate against the print blanket. Mechanical wear of the blanket 110 is caused by the direct interaction of the substrate on the impression cylinder 114 with the blanket 110. Under normal printing conditions, the image transfer member 108 and the impression cylinder 114 are engaged so as to bring the blanket 110 and the substrate into contact. The image transfer member 108 and the impression cylinder 114 are compressed together and can have a contact force between them. The force, for example, may be of the order of 3000 to 4000 N. Repeated high pressure contact between the blanket 110 and the substrate held on the impression cylinder 114 can cause edges of the media to cut into the blanket 110. Subsequently, when images are printed in areas that extend beyond those cuts (e.g. when a larger image is subsequently printed), the ink in the cut areas does not transfer well to the substrate, and the cuts become visible as defects in the printed output.

Null cycles are non-productive cycles that can exacerbate the damaging effects of these wear mechanisms, as well as cause drying of the print blanket, which can be another wear mechanism. During a null cycle, normal printing operations are suspended, for example in response to a null cycle trigger. During a null cycle, the printing press operates as if normal printing is being performed, but there is actually no image development or image transfer taking place. Most of the printing components remain operational so that, when the next print cycle begins, these components are ready to resume writing and transferring images as normal. For example, in a null cycle, the PIP 102, image transfer member 108 and impression cylinder 114 may continue to rotate.

During a so-called dry null cycle, there is no latent electrostatic image written onto the PIP 102, and no BID units 106 engaging the PIP 102. Therefore, there is no transfer of ink, solvents, oil, or other fluids from the BID units 106 to the PIP 102. Consequently, there is also no transfer of images, ink, solvents, oil, or other fluid from the PIP 102 to the blanket 110. However, during the dry null cycle, the heating and charging of the blanket 110 may continue so that the blanket 110 will be ready when normal printing operations resume. Continued heating and charging of the blanket 110 coupled with a lack of fluid transfer to the blanket 110 may cause the blanket 110 to become dry and partially adhesive, which can damage the blanket 110 and the PIP 102, and have a negative impact on the transfer of images and overall print quality.

In order to avoid wear caused by dry nulls, some LEP printing presses use so-called wet null cycles to wet the blanket 110 during the null cycle. Such wet null cycles involve applying wet null voltages to a BID unit 106 and engaging that BID unit 106 with the PIP 102. Engagement of a BID unit 106 with wet null voltages applied results in transfer of imaging oil from the engaged BID unit 106 to the PIP 102. The imaging oil transferred to the PIP 102 in turn wets the blanket 110. However, wetting the PIP 102 using a BID unit 106 may result in small amounts of ink also being transferred from the BID unit 106 to the PIP 102. Ink transferred during such a wet null cycle may be transferred to the blanket 110 and, over time, accumulate at the margin of the blanket 110 (i.e. where ink is not transferred to a substrate). The transferred ink residue may accumulate and dried ink residue may eventually peel away from the blanket 110 and return to the PIP 102. The dried residue may then scratch or otherwise damage the surface of the PIP 102.

Figure 2:
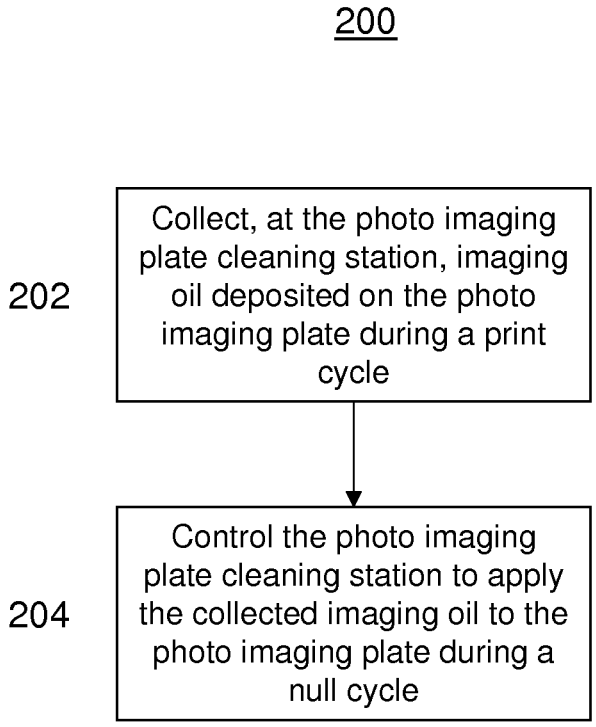
FIG. 2 is a flow diagram showing a method of operating a liquid electrophotographic printer according to an example.

FIG. 2 is a flow diagram illustrating a method 200 of operating a liquid electrographic printer (LEP), such as the printer described with reference to FIG. 1, which may help to alleviate the wear mechanisms described above.

At block 202, imaging oil deposited on the photo imaging plate during a print cycle is collected at the cleaning station 116. For example, the cleaning station 116 may collect imaging oil that is transferred when transferring ink from a BID unit 106 during a prior print cycle.

At block 204, the cleaning station 116 is controlled to apply the collected imaging oil to the PIP 102 during a null cycle.

Figure 3:
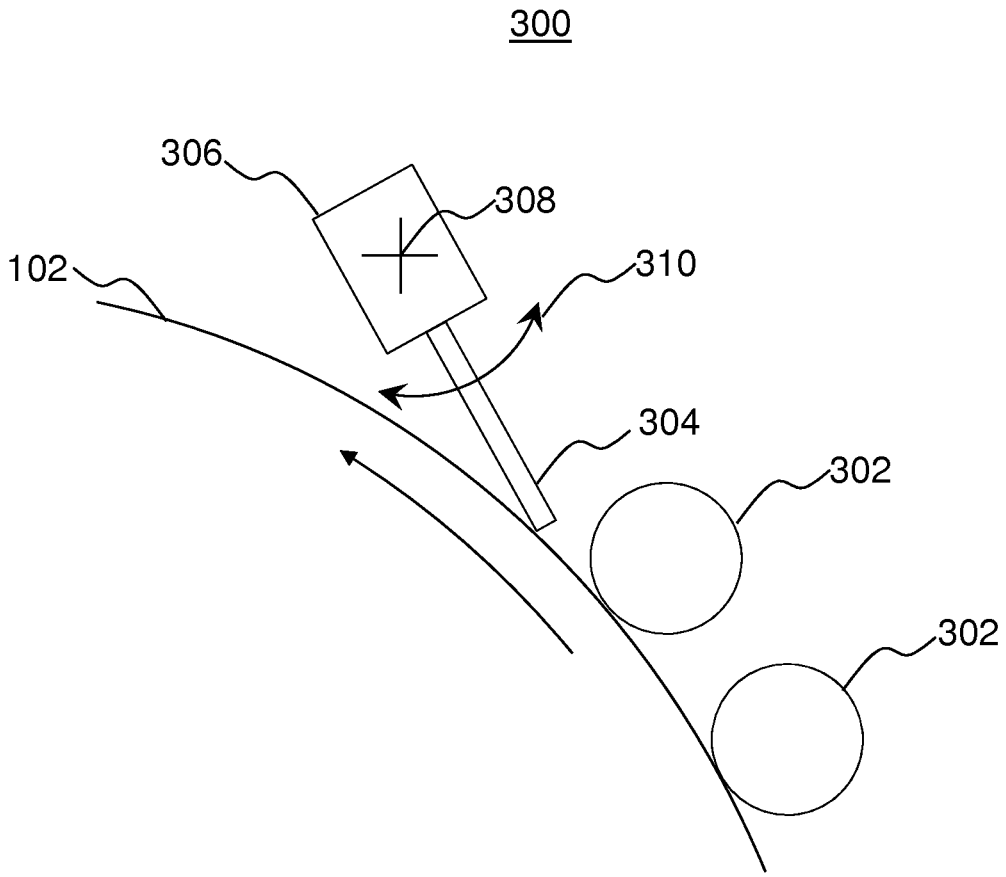
FIGS. 3, 8A, and 8B are schematic diagrams showing a cross section of a cleaning station in a liquid electrophotographic printer according to an example.

FIG. 3 illustrates the components of a cleaning station 300 according to an example. The cleaning station may be to perform the method 200 described above with reference to FIG. 2.

The cleaning station 300 in this example comprises two cleaning sponges 302 to remove colorant from the surface of the PIP 102. In other examples, the cleaning station 300 may have only one such cleaning sponge 302 or may have more than two such cleaning sponges 302. In this example, the cleaning station 300 has one wiper blade 304 to remove imaging oil from the surface of the PIP 102. In other examples, the cleaning station 300 may have two or more such wiper blades 304.

The wiper blade 304 is connected to a blade actuator 306. The blade actuator 306 is to rotate about an axis of rotation 308, thereby moving the blade through a range of angles 310 relative to the PIP 102. For example, the blade actuator 306 may be an eccentric cam stepper motor. In other examples, the blade actuator 306 may be a piezo actuator or a servo motor.

Figure 8A:
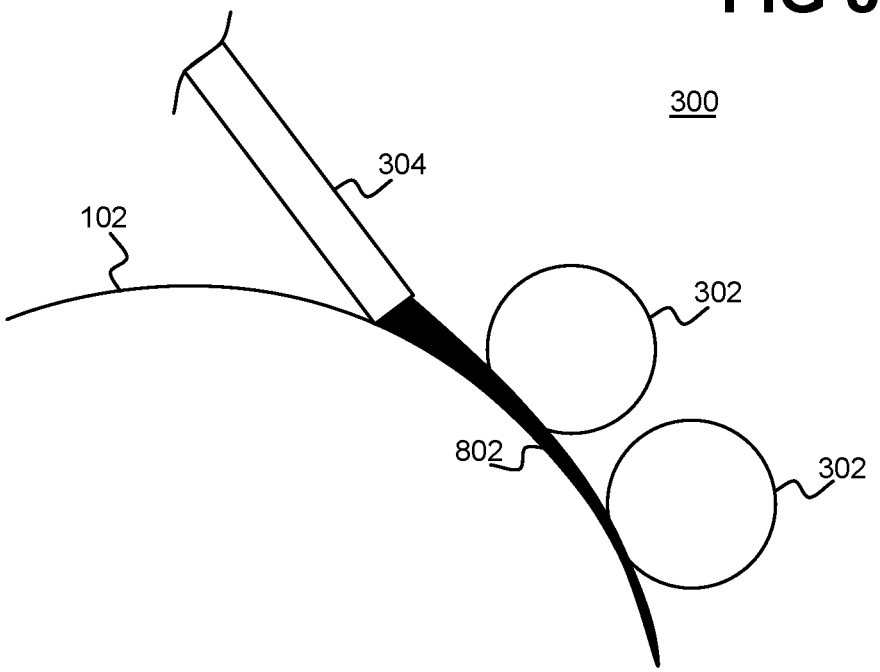

During a print cycle, the blade actuator 306 is controlled to position the blade 304 such that the blade 304 engages the PIP 102 (see FIG. 8A). The cleaning sponges 302 wipe or otherwise remove residual ink (i.e. colorant) from the PIP 102. In doing so, the cleaning sponges 302 may absorb imaging oil. The blade 304 engages the PIP 102 such that a force is applied by a tip of the blade 304 on the surface of the PIP 102. The force applied by the blade 304 on the PIP 102 may be controlled to be sufficiently high as to prevent a significant amount (e.g. substantially all) of the imaging oil that was transferred to the PIP 102 from the BID unit 106. The imaging oil is thereby collected at the cleaning station by the cleaning sponges 302 and the blade 304 (see FIG. 8A as to imaging oil 802; the blade 304 prevents the oil 802 from passing the blade 304).

Figure 8B:
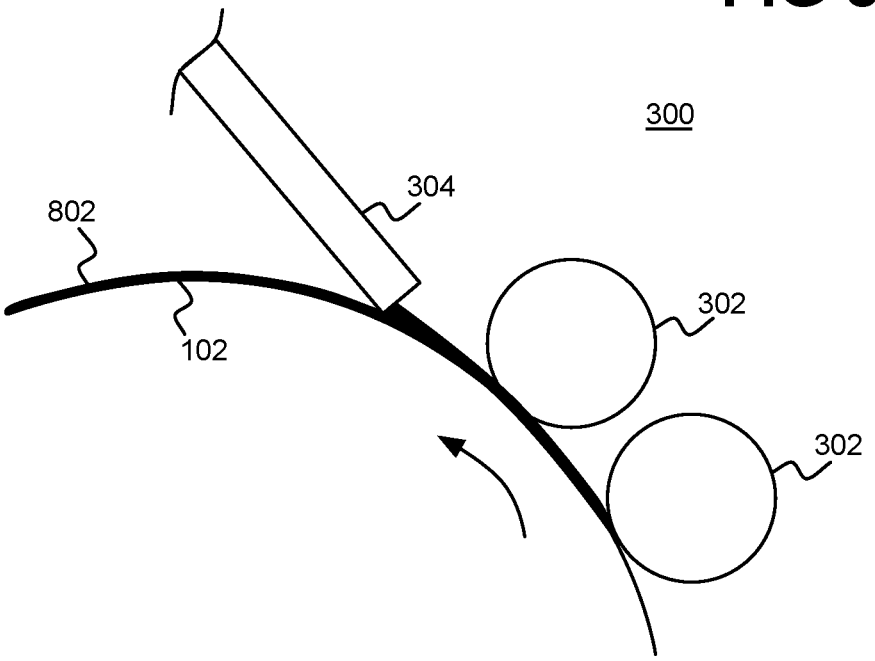

In a null cycle, the BID units 106 are disengaged from the PIP 102 so that no ink and no imaging oil is transferred from the BID units 106 to the PIP 102. The cleaning station 300 is controlled to apply previously collected imaging oil to the PIP 102. To apply imaging oil, the blade actuator 306 is controlled to position the blade 304 relative to the PIP 102 such that an amount of imaging oil is permitted to pass between the blade 304 and the PIP 102 (see FIG. 8B as to imaging oil 802), by reducing the amount of force applied by the blade 304 to the PIP 102 (including totally disengaging the blade 304 from the PIP 102 so no force is applied).

Figure 4:
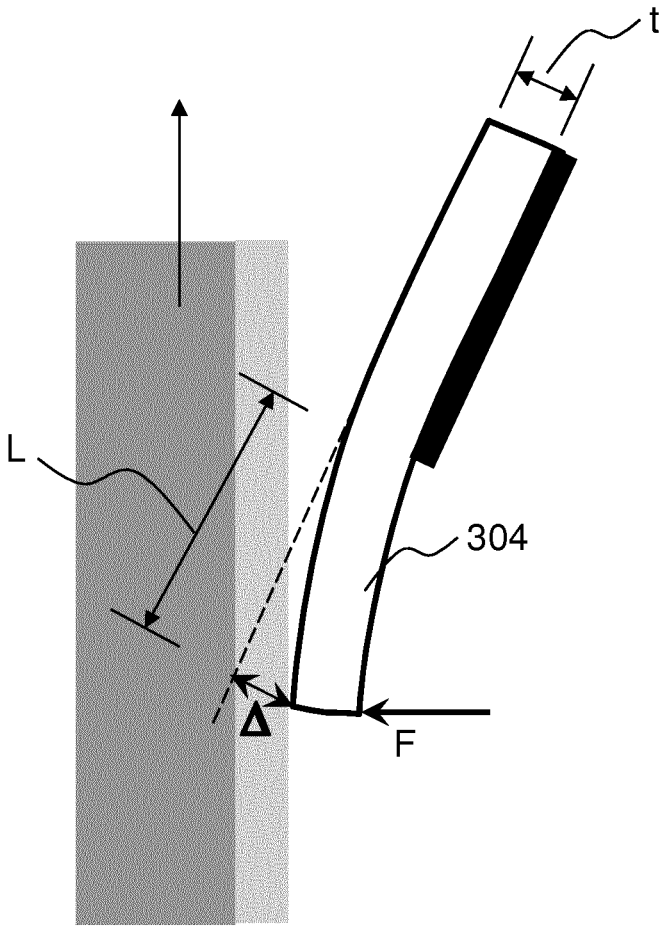
FIG. 4 is a schematic diagram illustrating the forces applied by a blade in a cleaning station of a liquid electrophotographic printer according to an example.

FIG. 4 schematically illustrates the forces applied the blade 304 of FIG. 3. The efficiency of the blade 304 (i.e. the fraction of oil that the blade 304 removes from the PIP 102 in a single pass) is at least partially determined by the pressure exerted by the blade 304 on the surface of the PIP 102. The pressure, P, exerted by the blade 304 is given by the force, F, applied by the blade 304 normal to the surface of the PIP 102 divided by the area, $\upsilon$, of the blade 304 in contact with the PIP 304. This can be expressed as:

$$P = \frac{F}{\upsilon}$$

The force varies approximately linearly with the deflection, $\Delta$, of the blade 304, and with the spring constant, K, and can be expressed as:

$$F = K\Delta$$

The spring constant, K, is a measure of the stiffness of the blade 304, which is a function of the thickness, t, and free length, L, of the blade 304. The spring constant can be expressed as:

$$K = E \cdot \left(\frac{t}{L}\right)^3$$

where E is the modulus of elasticity of the blade 304.

Figure 5:
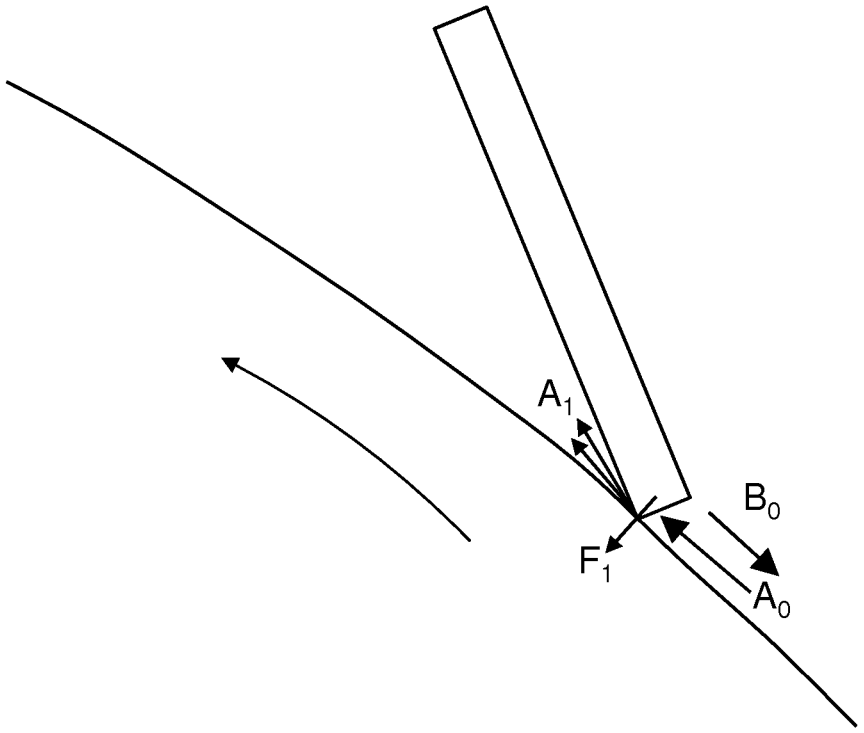
FIG. 5 is a schematic diagram illustrating a phenomenological model that can be used to describe the efficiency of a blade in a cleaning station of a liquid electrophotographic printer according to an example.

FIG. 5 schematically illustrates a phenomenological model that can be used to describe the efficiency of the blade 304 in terms of the fraction, t, of imaging oil that is transmitted between the blade 304 and the PIP 102.

As shown in FIG. 5, $A_0$ is an amount of imaging oil that arrives at the blade 304 (i.e. that is carried on the PIP 102 before reaching the blade 304), $A_1$ is an amount of imaging oil that is transmitted by the blade 304 (i.e. that is carried on the PIP 102 after passing the blade 304), and $B_0$ is an amount of imaging oil that is collected or removed by the blade 304 (i.e. that is prevented from being carried by the PIP 102 after passing the blade 304). $F_1$ is a force applied by the blade 304 normal to the surface of the PIP 102.

The fraction, t, of imaging oil that is transmitted by the blade 304, is given by:

$$t = 1 - r = A_1/A_0$$

where r is the amount of oil that is removed by the blade 304, and is given by:

$$r = \tanh\left(\frac{F_1}{F_0}\right)$$

where $F_0$ is an empirically derived constant representing a geometric factor affecting performance of the blade 304. For example, $F_0$, may be a function of the radius of an edge of the blade, with a smaller radius providing more efficient removal of imaging oils by the blade 304 from the PIP 102.

Figure 6:
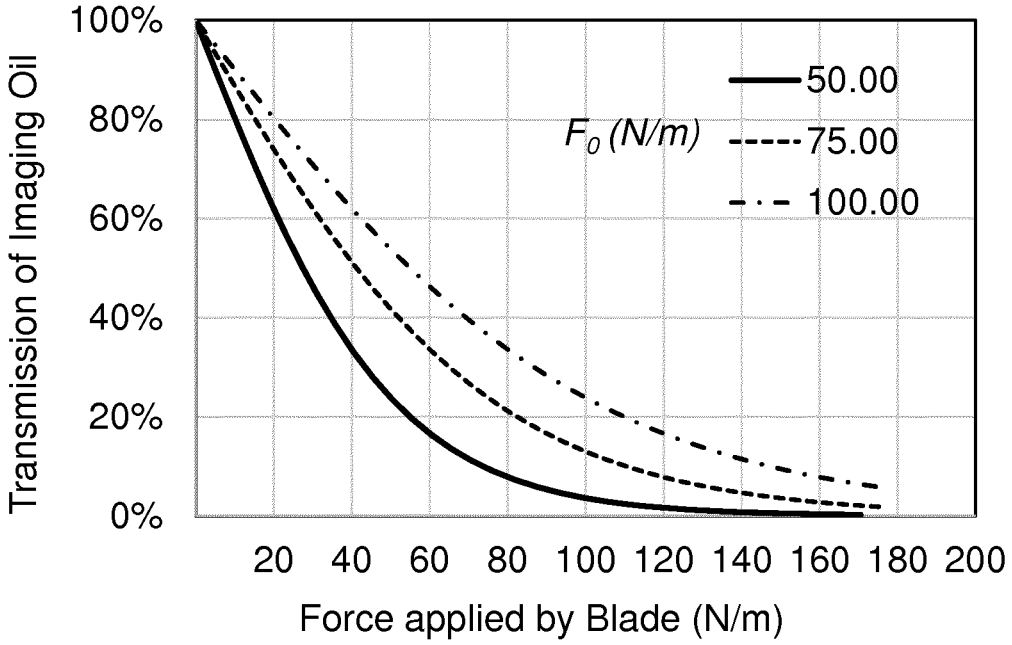
FIG. 6 is a graph illustrating the transmission properties for blades in a cleaning station of a liquid electrophotographic printer according to an example.

FIG. 6 is a graph illustrating the transmission properties for blades modelled with the phenomenological model described above with reference to FIG. 5.

As can be seen from FIG. 6, the amount of imaging oil transmitted by the blade 304 is controllable or variable by controlling the force applied by the blade 304 on the surface of the PIP 102. In particular, when it is desired to remove or collect most or all of the imaging oil from the PIP 102 (i.e. during a print cycle, as described with reference to block 202 of FIG. 2), the force applied by the blade 304 can be increased. For example, the force applied by the blade 304 may be increased to provide a pressure exceeding a threshold pressure above which most or all of the imaging oil is removed or collected from the PIP 102. In an example, the force applied by the blade 304 may be set to 100 N/m or greater. When it is desired to transmit a significant amount of imaging oil between the blade 304 and the PIP 102 (i.e. during a null cycle, as described with reference to block 204 of FIG. 2), the force applied by the blade 304 can be decreased. For example, the force applied by the blade 304 may be set to 40 N/m or less. In one example, during a print cycle, the force applied by the blade 304 is in a range between 80 N/m and 160 N/m and during a null cycle the force applied by the blade 304 is in a range between 0 N/m and 40 N/m. In one example, during a print cycle the force applied by the blade 304 is set to 130 N/m and during a null cycle the force applied by the blade 304 is set to 30 N/m.

In some examples, the force applied by the blade 304 on the PIP 102 may be tuned by controlling or modulating a degree of rotation of the blade actuator 306 about its rotation axis 308 relative to the PIP 102 to control or modulate an amount, or thickness, of imaging oil that is applied by the cleaning station 300 to the PIP 102 during a null cycle. In other examples, the blade actuator 306 can totally disengage the blade 304 from the PIP 102 (i.e. so that the blade 304 applies no force to the PIP 102) to allow oil to be applied to the PIP 102 without thickness control.

Figure 7:
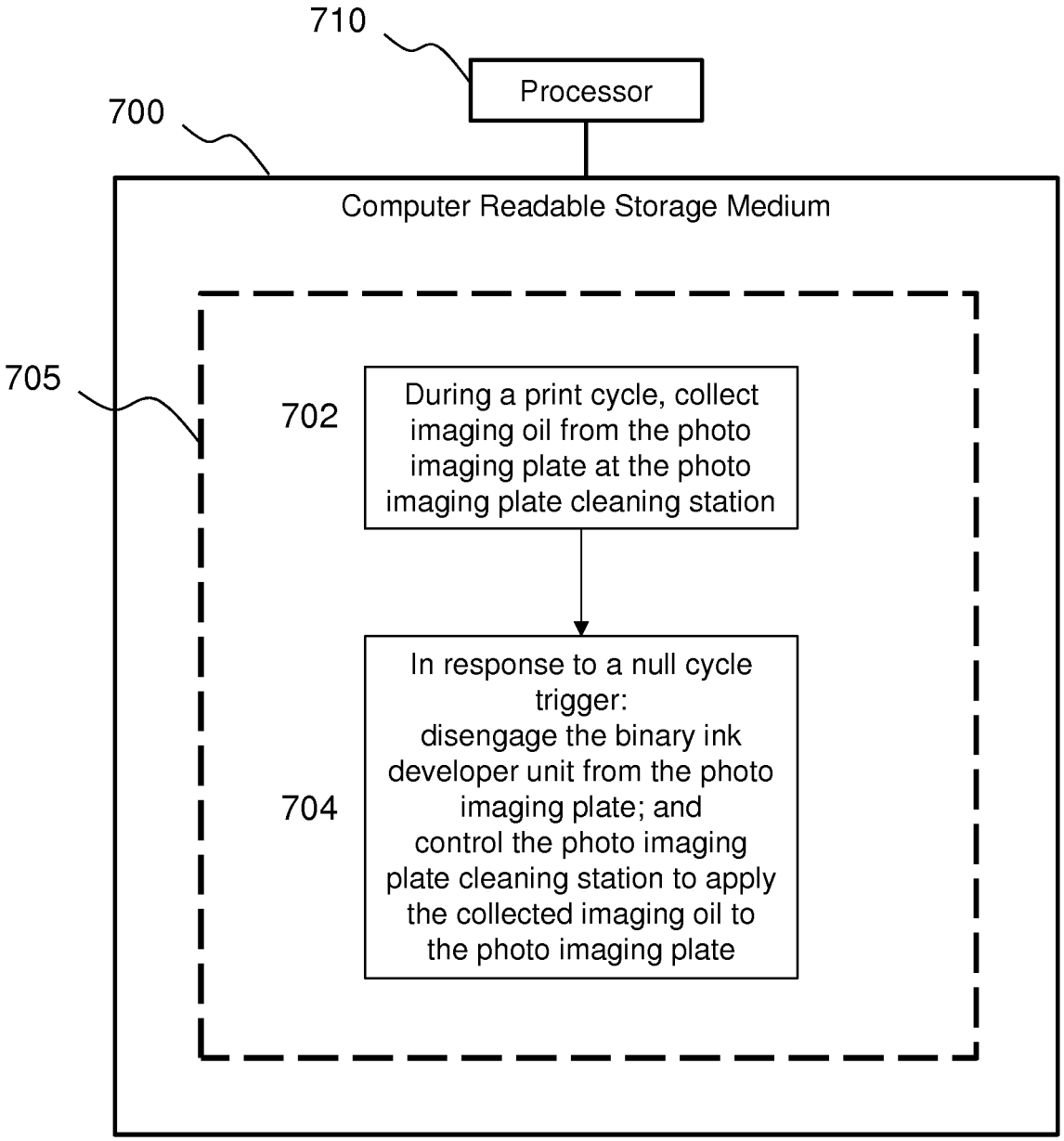
FIG. 7 is a schematic diagram showing a storage medium storing instructions for performing a null cycle in a liquid electrophotographic printer according to an example.

FIG. 7 shows an example of a non-transitory computer-readable storage medium 700 comprising a set of computer readable instructions 705 which, when executed by a processor 710 in a liquid electrophotographic printer, cause the processor 710 to perform a method by which a photo imaging plate cleaning station may be controlled to apply collected imaging oil to a photo imaging plate. In other examples, the method may be performed by an entity other than the processor 710, e.g. without being embodied in computer-readable instruction. The liquid electrophotographic printer may comprise a device as described above, e.g. comprising a BID unit 106 and a PIP 102. The processor 710 may form part of a print controller. The computer readable instructions 705 may be retrieved from a machine-readable media, e.g. any media that can contain, store, or maintain programs and data for use by or in connection with an instruction execution system. In this case, machine-readable media can comprise any one of many physical media such as, for example, electronic, magnetic, optical, electromagnetic, or semiconductor media. More specific examples of suitable machine-readable media include, but are not limited to, a hard drive, a random access memory (RAM), a read-only memory (ROM), an erasable programmable read-only memory, or a portable disc. The processor 710 may perform the method as part of a calibration routine for the liquid electrophotographic printer.

At instruction 702, during a print cycle, the photo imaging plate cleaning station 300 is instructed to collect imaging oil from the photo imaging plate 102. For example, the blade actuator 306 may be positioned such that the blade 304 applies a sufficiently high force to the surface of the PIP 102 to prevent a significant amount (e.g. substantially all) of the imaging oil from the surface of the PIP 102.

At instruction 704, in response to a null cycle trigger, the BID unit 106 is instructed to disengage from the photo imaging plate. At instruction 704, control of the photo imaging plate cleaning station to apply the collected imaging oil to the photo imaging plate is instructed. For example, the blade actuator 306 may be controlled to position the blade 304 relative to the PIP 102 such that an amount of imaging oil is permitted to pass between the blade 304 and the PIP 102.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. A method of operating a liquid electrographic printer, the liquid electrographic printer comprising a photo imaging plate, and a photo imaging plate cleaning station, the method comprising:

collecting, at the photo imaging plate cleaning station, imaging oil deposited on the photo imaging plate during a print cycle; and controlling the photo imaging plate cleaning station to apply the collected imaging oil to the photo imaging plate during a null cycle during which ink transfer to the photo imaging plate is suspended.

2. The method of claim 1, wherein the photo imaging plate cleaning station comprises a cleaner and an imaging oil collector, and wherein the collecting comprises cleaning ink particles from the photo imaging plate with the cleaner and collecting imaging oil from the photo imaging plate with the imaging oil collector.

3. The method of claim 1, wherein the controlling comprises controlling a position of an imaging oil collector of the photo imaging plate cleaning station relative to the photo imaging plate.

4. The method of claim 1, wherein the controlling comprises controlling a force applied by an imaging oil collector of the photo imaging plate cleaning station on the photo imaging plate.

5. The method of claim 1, wherein the liquid electrophotographic printer comprises a binary ink development unit, the method comprising:

following a null cycle, engaging the binary ink development unit with the photo imaging plate to deposit ink particles and imaging oil on the photo imaging plate.

6. The method of claim 1, wherein the collected imaging oil is applied to the photo imaging plate by reducing a force at which a wiper of the photo imaging plate cleaning station is applied against the photo imaging plate.

7. The method of claim 6, wherein the force at which the wiper is applied against the photo imaging plate is reduced to zero.

8. The method of claim 1, wherein the collected imaging oil is applied to the photo imaging plate by disengaging the wiper from the photo imaging plate.

9. A liquid electrophotographic printer, comprising:

a binary ink development unit;

a photo imaging plate; and a cleaning station to collect imaging oil from the photo imaging plate during a print cycle;

wherein, in a null cycle, the binary ink developer is to disengage from the photo imaging plate and the cleaning station is to deposit the collected imaging oil on the photo imaging plate.

10. The liquid electrophotographic printer of claim 9, wherein the binary ink development unit is to transfer ink particles suspended in an imaging oil to the photo imaging plate, and wherein the cleaning station comprises:

an ink particle remover to remove ink particles from the photo imaging plate; and an imaging oil remover to remove imaging oil from the photo imaging plate.

11. The liquid electrophotographic printer of claim 10, wherein the ink particle remover is a sponge or wherein the imaging oil remover is a wiper blade.

12. The liquid electrophotographic printer of claim 11, comprising a wiper actuator supporting the wiper blade, wherein the wiper actuator is to position the wiper blade to apply a first force on the photo imaging plate during the print cycle and to position the wiper blade to apply a second force on the photo imaging plate during the null cycle, and wherein the first force is greater than the second force.

13. The liquid electrophotographic printer of claim 12, wherein the first force is in a range between 80 N/m and 160 N/m and the second force is in a range between 0 N/m and 40 N/m.

14. The liquid electrophotographic printer of claim 12, comprising a controller, wherein the controller is to:

determine that a null cycle is to be performed; and in response to determining that a null cycle is to be performed, generating a signal to control the wiper actuator to position the wiper blade to apply the second force on the photo imaging plate.

15. The liquid electrophotographic printer of claim 12, wherein the wiper actuator is to disengage the wiper blade from the photo imaging plate during the null cycle.

16. The liquid electrophotographic printer of claim 12, comprising a controller to control the wiper actuator to vary a force applied by the wiper blade on the photo imaging plate.

17. The liquid electrophotographic printer of claim 12, wherein the wiper actuator is one of: an eccentric cam stepper motor; a servo motor; and a piezo actuator.

18. A non-transitory machine-readable storage medium storing instructions that, when executed by a processor of a liquid electrophotographic printer, the liquid electrophotographic printer comprising a binary ink development unit, a photo imaging plate, and a photo imaging plate cleaning station, causes the liquid electrophotographic printer to:

during a print cycle, collect imaging oil from the photo imaging plate at the photo imaging plate cleaning station; and in response to a null cycle trigger:

disengage the binary ink developer unit from the photo imaging plate; and control the photo imaging plate cleaning station to apply the collected imaging oil to the photo imaging plate.

* * * * *